US005915517A

United States Patent [19]

Tansky

[11] Patent Number: 5,915,517

[45] Date of Patent: Jun. 29, 1999

[54] COIN DIVERTER

[75] Inventor: John L. Tansky, Sewell, N.J.

[73] Assignee: Mars Incorporated, McLean, Va.

[21] Appl. No.: 08/910,845

[22] Filed: Aug. 13, 1997

[51] Int. Cl.[6] ..... G07F 3/00; G07F 1/04

[52] U.S. Cl. ..... 194/202; 194/344

[58] Field of Search ..... 194/344, 347, 194/348, 349, 202, 203, 223, 221; 379/145

[56] References Cited

U.S. PATENT DOCUMENTS

| | | | |
|---|---|---|---|
| 2,122,550 | 7/1938 | Adrian | 194/227 |
| 3,157,064 | 11/1964 | Moeller . | |
| 4,821,863 | 4/1989 | Okada | 194/344 |
| 5,054,056 | 10/1991 | Blythe | 194/202 |
| 5,187,738 | 2/1993 | Zausner | 379/145 |
| 5,473,678 | 12/1995 | Anello et al. . | |

*Primary Examiner*—F. J. Bartuska
*Assistant Examiner*—Bryan J. Jaketic
*Attorney, Agent, or Firm*—Fish & Richardson P.C.

[57] ABSTRACT

Apparatus and methods for minimizing incorrect coin registration in a coin-operated telephone. The apparatus includes a coin diverter having a top plate, a coin hopper mounting bracket, and a coin impact plate attached to the top plate. The coin impact plate is positioned in a coin hopper entry path to alter the orientation of a coin entering the hopper. The methods include attaching a coin diverter to a coin hopper and diverting coins entering the coin hopper to prevent impacts on an edge of a trip lever.

11 Claims, 8 Drawing Sheets

COIN DIVERTER

BACKGROUND

This invention relates to coin detection devices, and more particularly, to a coin diverter for use with pay telephone coin detector devices.

In a typical coin operated telephone, a coin inserted in a coin slot travels from the coin slot to a coin validator via a coin chute. The coin validator determines the value and authenticity of acceptable coins, and rejects counterfeit or invalid coins and non-coin objects. Acceptable coins are directed to a coin box while rejected objects exit the phone through a return slot.

After an acceptable coin departs the coin validator, it is directed to a coin hopper where it impacts a trip lever. The impact of the coin causes the trip lever to pivot from a nontriggered position to a triggered position. As the trip lever moves from the nontriggered position a space opens in the coin passageway enabling the coin to pass into the coin box. As the trip lever further moves toward the fully triggered position, electrical contact closure is caused by the displaced trip lever resulting in coin credit registration.

Credit registration may fail if the impact of the coin with the trip lever imparts insufficient force to move the trip lever to the fully triggered position. This type of failure may occur when a small lightweight coin such as a dime impacts the trip lever, and the failure is particularly acute when the orientation of the dime results in a low-force impact between the edge of the dime and the edge of the lever. It has been observed that such an impact moves the trip lever sufficiently to allow the dime to pass into the coin box but not enough to cause coin registration contact closure. As a result, the user's coin is retained in the coin box, but the user is not credited for the deposited coin.

Consequently, a need exists for a device to ensure that accurate credit registration occurs when lightweight coins are deposited in a pay telephone.

SUMMARY

In general, the invention features a coin diverter for a coin-operated telephone including a top plate, a mounting bracket connected to the top plate, and a diverter plate attached to the top plate. When the coin diverter is mounted the diverter plate is positioned in a coin hopper entry path to deflect coins to minimize edge impacts of coins with a trip lever.

Implementations of the invention may include one or more of the following. The coin diverter may be mounted on the coin hopper. The diverter plate may measure approximately 25 millimeters (mm) by 9.5 mm. The coin diverter may include a fraud prevention plate attached to the top plate. The fraud prevention plate may include multiple interconnected segments. The fraud prevention plate may be flexibly attached to the top plate. The fraud prevention plate may be positioned between the coin hopper and a coin telephone housing box when the coin diverter is mounted.

In general, in another aspect, the invention features a method for minimizing incorrect coin registration in a coin operated telephone. The method includes attaching a coin diverter to a coin hopper and diverting coins to prevent impacts on an edge of a trip lever.

Among the advantages of the invention are one or more of the following. The coin diverter may reduce coin credit registration failures, it may be retrofit to a conventional coin telephone coin hopper without substantial modifications, and it may include coin registration failure prevention and coin box tamper resistant features in a one piece unit.

Other advantages of the present invention will become apparent from reading the specification and drawings.

DETAILED DESCRIPTION

Figure 1B:
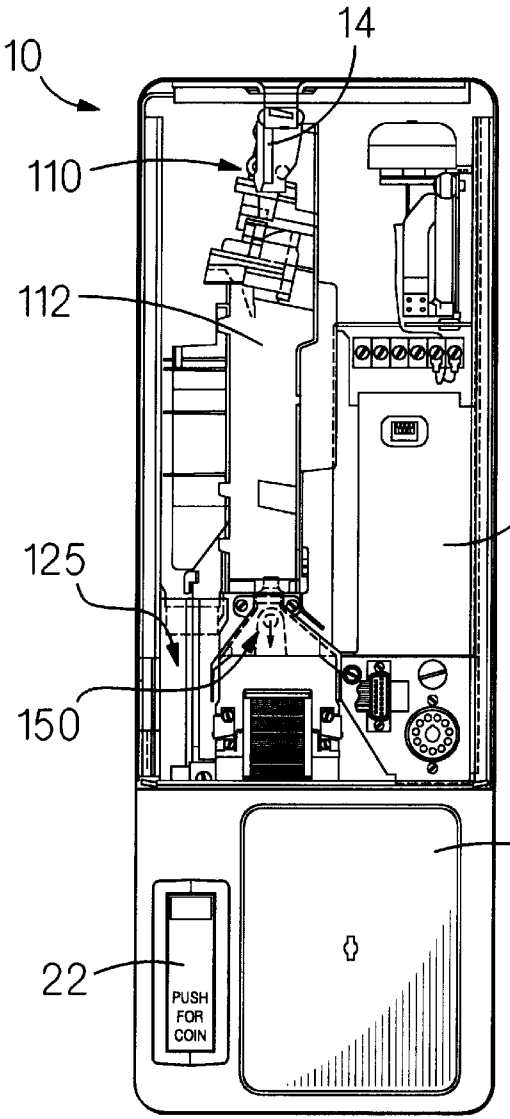
FIG.1B (PRIOR ART)
FIG. 1B is a front view of a coin operated telephone with the front plate removed.
Figure 1A:
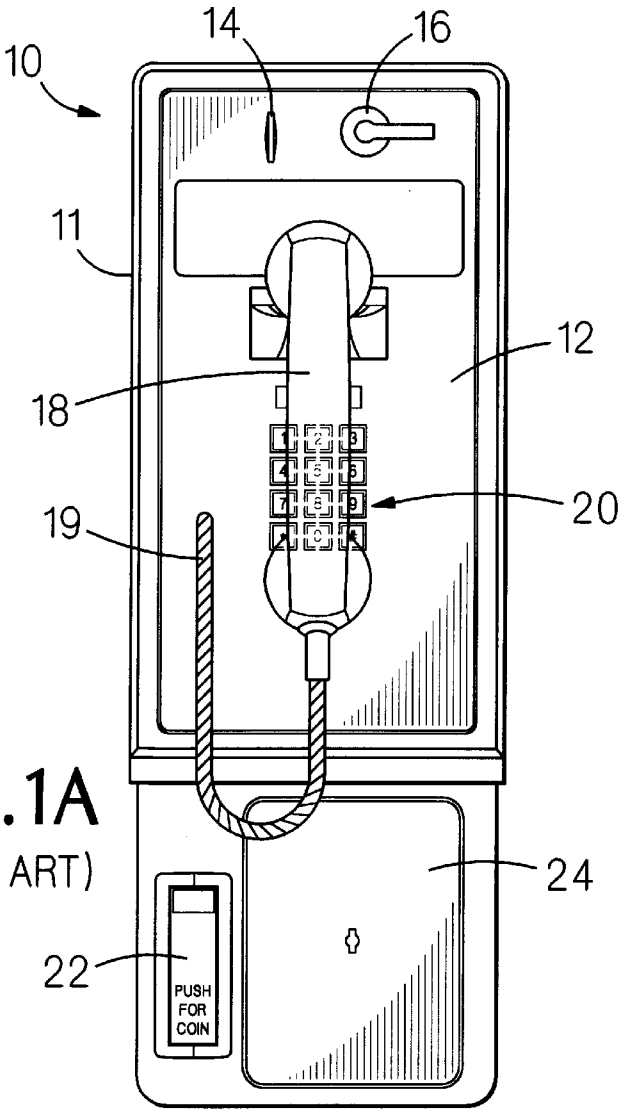
FIG.1A (PRIOR ART)
FIG. 1A is a front schematic view of a coin operated telephone.

FIG. 1A is a front view of a typical coin operated telephone 10 having a housing box 11. The upper face plate 12 of the pay phone 10 has a coin slot 14, a coin return lever 16, a handset 18 and cord 19, and a keypad 20. The lower portion of the pay phone has a coin return receptacle 22 and a vault door 24 which protects a coin box (not shown).

FIG. 1B is a front view of the coin operated telephone 10 of FIG. 1A with the face plate of the housing box 11 removed to show a coin validator 110. The housing box 11 typically contains an electromechanical apparatus 120 for the operation of the telephone. The apparatus 120 may have, for example, copper line termination functions, signal generation functions, call origination functions, coin credit accumulation functions, and other pay telephone functionality. Additionally, the housing box 11 contains a coin return relay unit that is generally located in the lower portion of the housing box.

To operate the pay phone 10, a customer removes the handset 18 from its cradle and inserts coins into the coin slot 14. The inserted coins travel from the coin slot 14 through a coin passageway to the coin validator 110 where the coin is analyzed by detection and validation circuitry. After analysis, unacceptable coins and non-coin objects are directed through coin passageway 125 to the coin return receptacle 22 while acceptable coins are directed through coin chute 112 to a coin hopper 150.

Figure 2A:
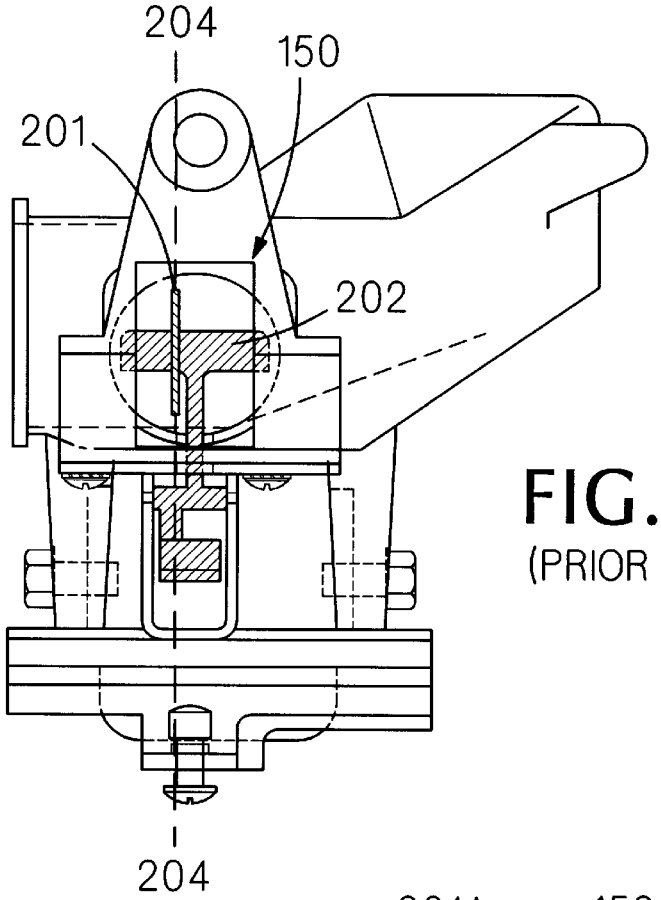
FIG. 2A (PRIOR ART)
FIGS. 2A, 2B, 3A, and 3B are schematic views of a coin hopper.
Figure 2B:
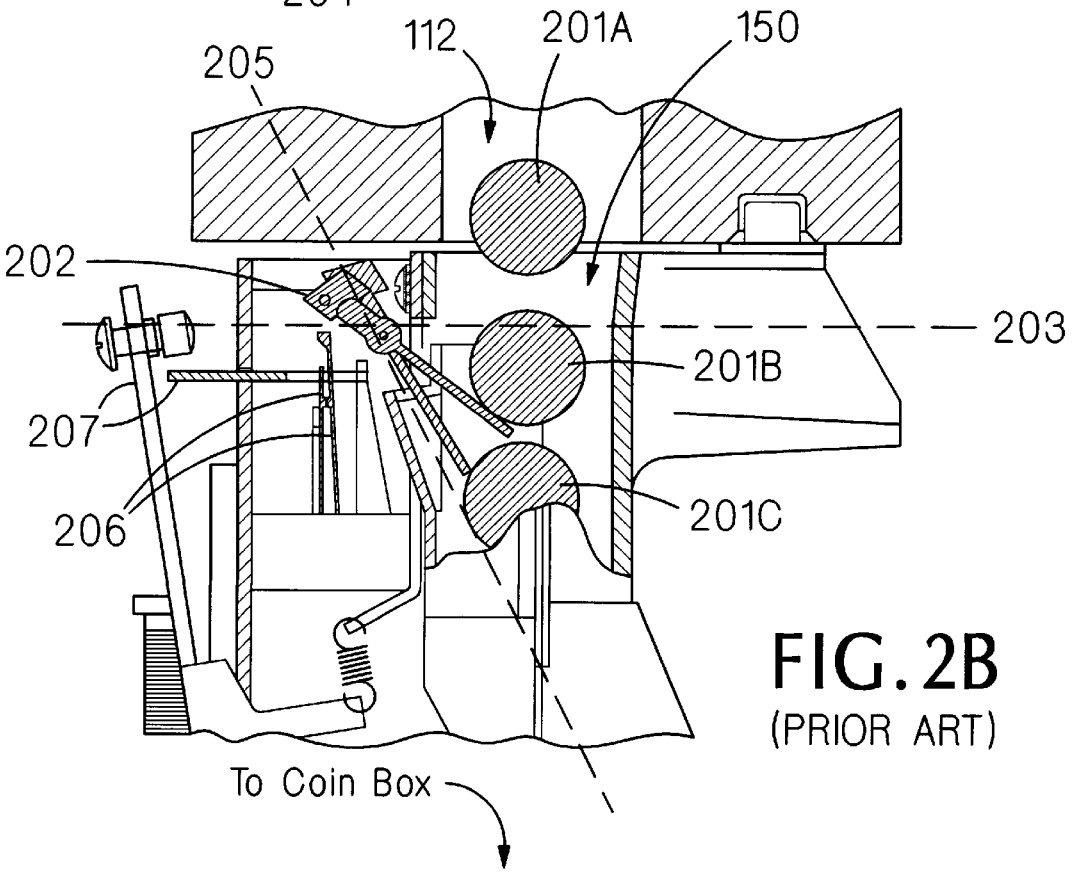
FIG. 2B (PRIOR ART)

FIG. 2A is a top view and FIG. 2B is a side schematic view of a coin hopper 150. A coin 201 is shown in both FIGS. 2A and 2B as it enters a coin hopper 150. In FIG. 2B, the coin is shown in three locations, 201A as it enters the coin hopper, 201B as the coin encounters a trip lever 202, and 201C as the coin moves past the trip lever 202.

Referring to FIG. 2B, as a valid coin 201 exits coin chute 112 it enters a coin hopper 150. As the coin moves from position 201A to position 201B it will engage trip lever 202 within the coin hopper 150, causing the trip lever 202 to move from a nontriggered position along horizontal axis 203 toward its maximum triggered position along axis 205. As the trip lever moves from its initial position (along axis 203)

the coin will pass through the coin hopper 150 and into the pay telephone coin box. When the trip lever approaches its fully pivoted position (along axis 205), contact elements 206 close resulting in credit registration for the deposited coin. The trip lever 202 is subsequently reset to its nontriggered position along axis 203 by trip lever reset mechanism 207. Trip levers and their associated contact closure and reset mechanisms are more fully described in, for example, U.S. Pat. No. 3,157,064.

Figure 3A:
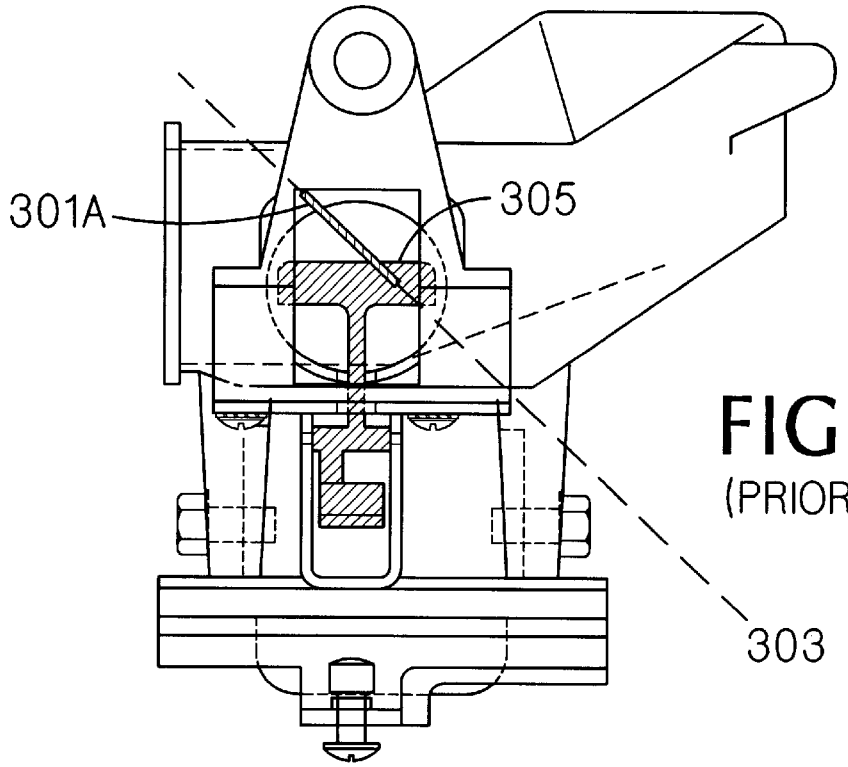
FIG. 3A (PRIOR ART)
Figure 3B:
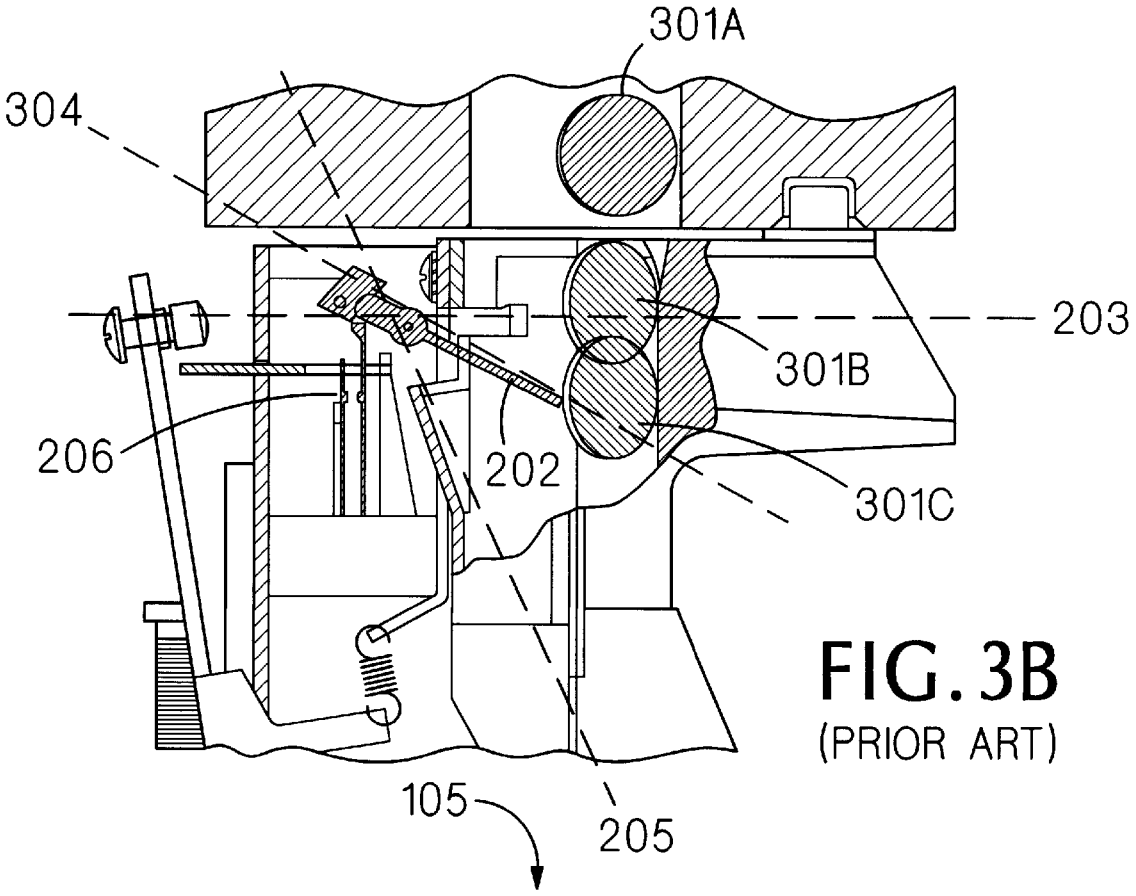
FIG. 3B (PRIOR ART)

A portion of the trip lever 202 is positioned within coin hopper 150 and is impacted by a coin entering the coin hopper. In FIG. 2A, the coin is shown ready to impact the trip lever 202 along axis 204 which will reliably result in pivotal movement of the trip lever 202, causing closure of coin detection contacts 206. Referring to FIGS. 3A and 3B, however, if a dime or other small coin 301A enters the coin hopper 150 oriented along, for example, axis 303, the coin may glance off an edge 305 of the trip lever. Such an impact will impart less motion to trip lever 202 than would an impact along a non-edge region. Edge impacts may cause trip lever movement to an intermediate position between the fully triggered 205 and non-triggered 203 axis. Movement of the trip lever to an intermediate position, such as along axis 304 in FIG. 3B, may allow coin 301C passage, while not causing trip lever contact 206 closure. In such a case, the coin is directed to the pay phone coin box without crediting the user for the deposited coin. Such coin edge impacts have been observed to occur in, for example, the Western Electric model "1A" and "1AAA" coin detection mechanisms.

Figure 4A:
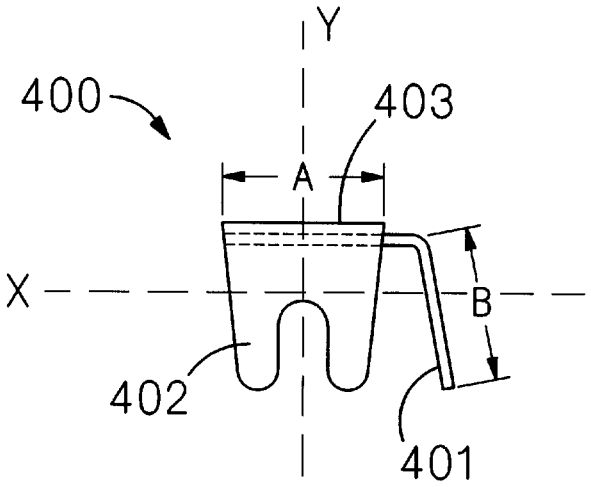
FIGS. 4A, 4B and 4C are, respectively, side, top, and front schematic views of a coin diverter.
Figure 4B:
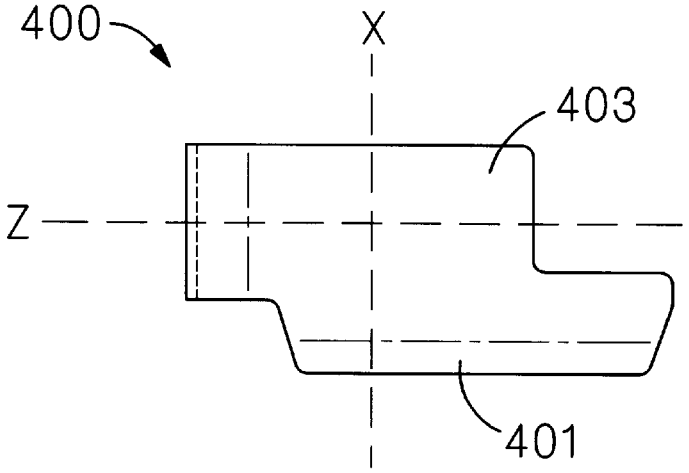
Figure 4C:
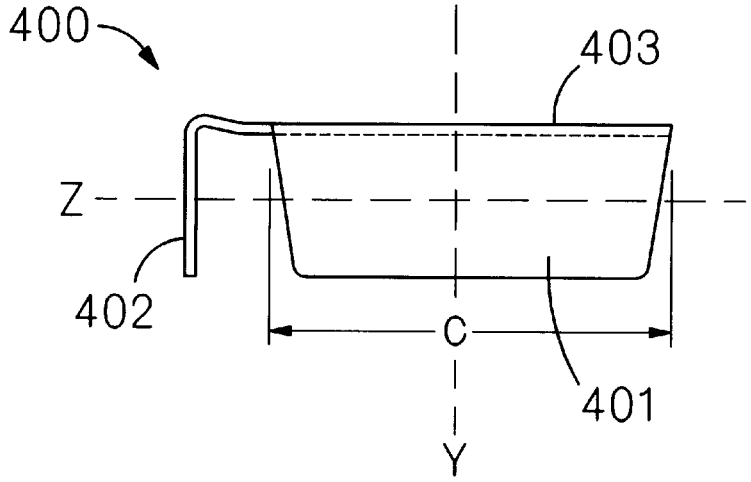

FIGS. 4A, 4B, and 4C are side, top and front views of a coin diverter 400 for preventing trip lever edge impacts. The coin diverter 400 has a sloped coin diverter plate 401, (also referred to as a coin impact plate) a generally U-shaped mounting bracket 402 and a top plate 403. The mounting bracket 402 is designed to retrofit the coin diverter 400 to coin mechanisms such as the Western Electric "1A" and "1AAA" mechanisms It should be understood that other mounting bracket designs may be required for other models or for attachment to coin mechanisms from other manufacturers. The coin diverter 400 may be fashioned from, for example, stainless steel, other metals, plastic, ceramic, or a composite material. In addition, the coin diverter 400 may be manufactured as an integral unit or separate components connected together.

In an exemplary coin diverter designed to retrofit a Western Electric "1A" or "1AAA" coin mechanism, the coin diverter is constructed of stainless steel having a thickness of 0.6 mm. The diverter plate 401 has measurements "B", and "C" as illustrated in FIGS. 4A and 4C. Length measurement "B" is approximately 9.5 millimeters (mm) (FIG. 4A) and width measurement "C" is approximately 25 mm (FIG. 4C). The mounting bracket 402 has a measurement "A" of approximately 10.0 mm (FIG. 4A).

Figure 5A:
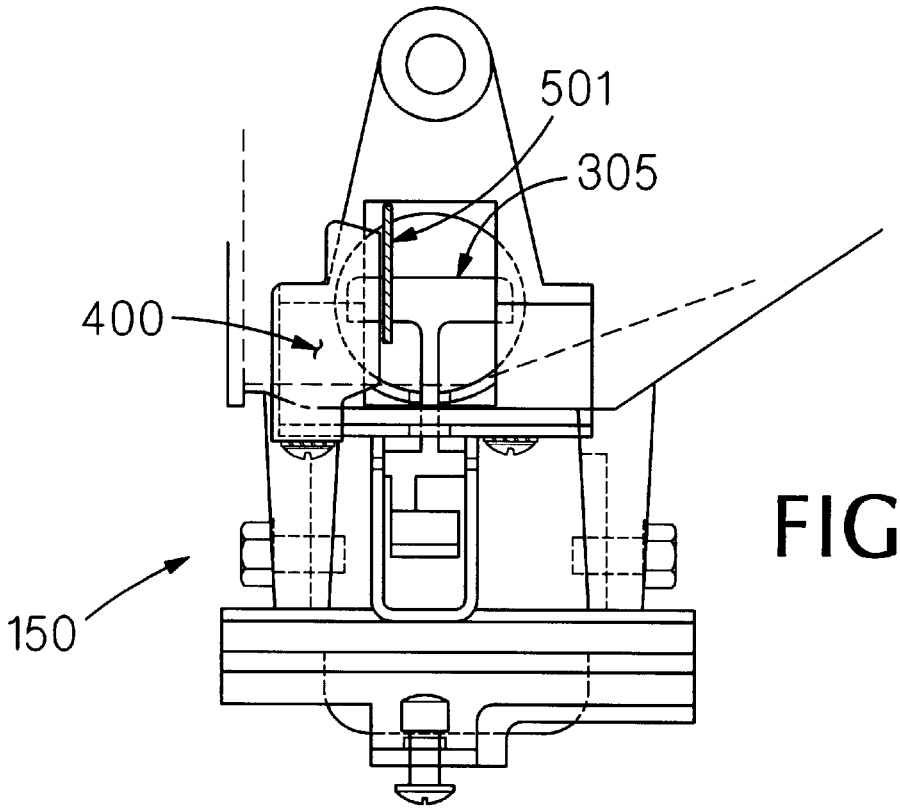
FIGS. 5A and 5B are, respectively, a top and a side schematic view of a coin hopper having an installed coin diverter.
Figure 5B:
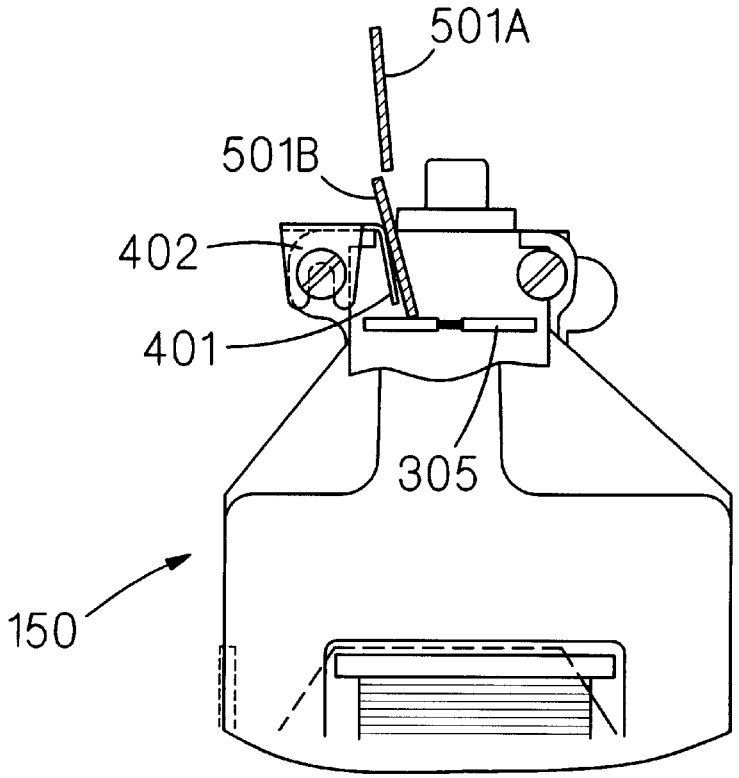

FIGS. 5A and 5B show a coin 501 entering a coin hopper with an installed coin diverter 400. A coin 501 is shown in both FIGS. 5A and 5B as it enters a coin hopper 150. In FIG. 5B, the coin is shown in two locations, 501A as it enters the coin hopper, 501B as the coin is deflected by the coin diverter deflection plate 401. The coin diverter is mounted directly upon the coin hopper 150 by use of the integral mounting bracket 402. The diverter plate 401 is positioned within coin hopper 150, and directs the orientation of coins entering the coin hopper 150 so that dimes and other coins are prevented from impacting the trip lever edge 305. By so restricting coin alignment, low pivotal force impacts between the coin and trip lever edge are eliminated. As a result, incidents of insufficient trip lever movement are substantially eliminated so that coin passage credit failures are minimized and virtually eliminated.

Figure 6A:
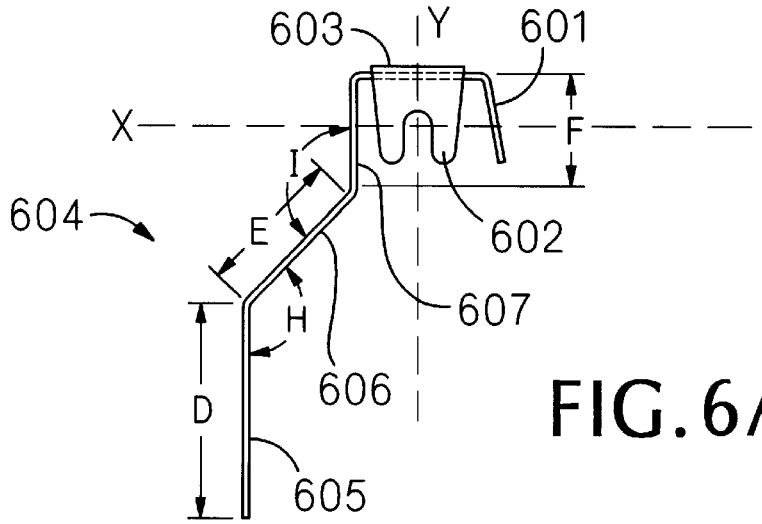
FIGS. 6A, 6B and 6C are, respectively, a bracket-end, top, and side schematic views of a coin diverter.
Figure 6B:
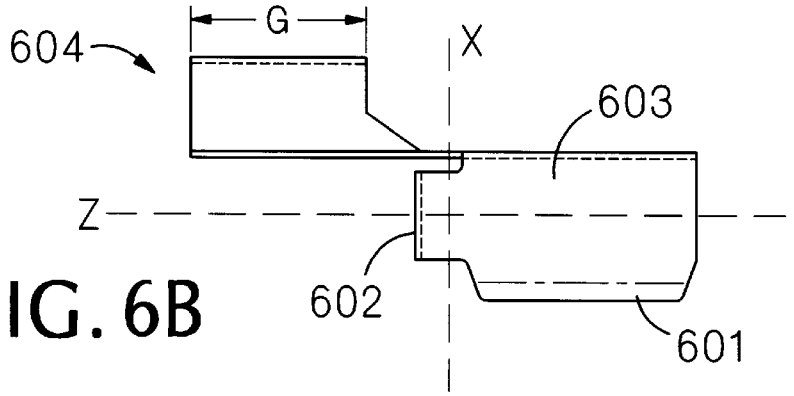
Figure 6C:
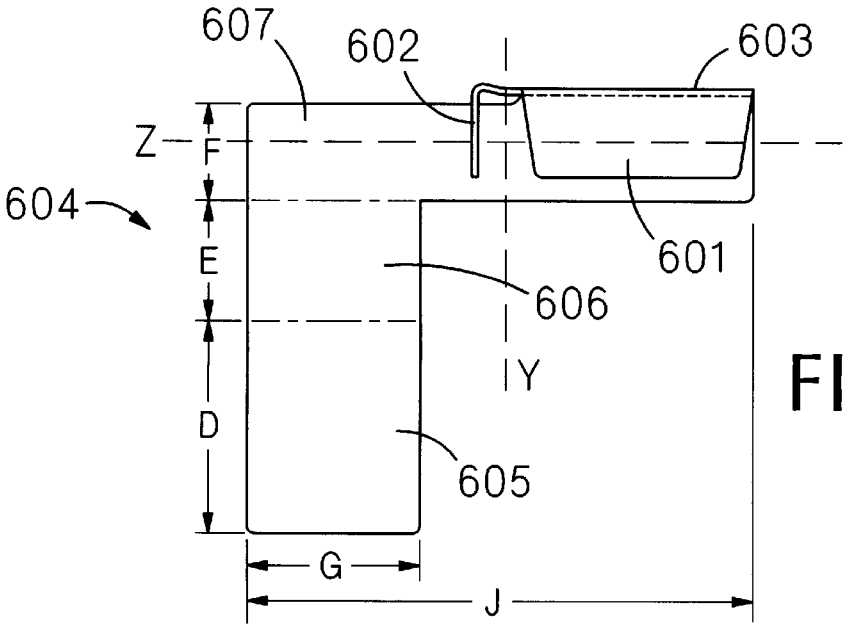
Figure 8:
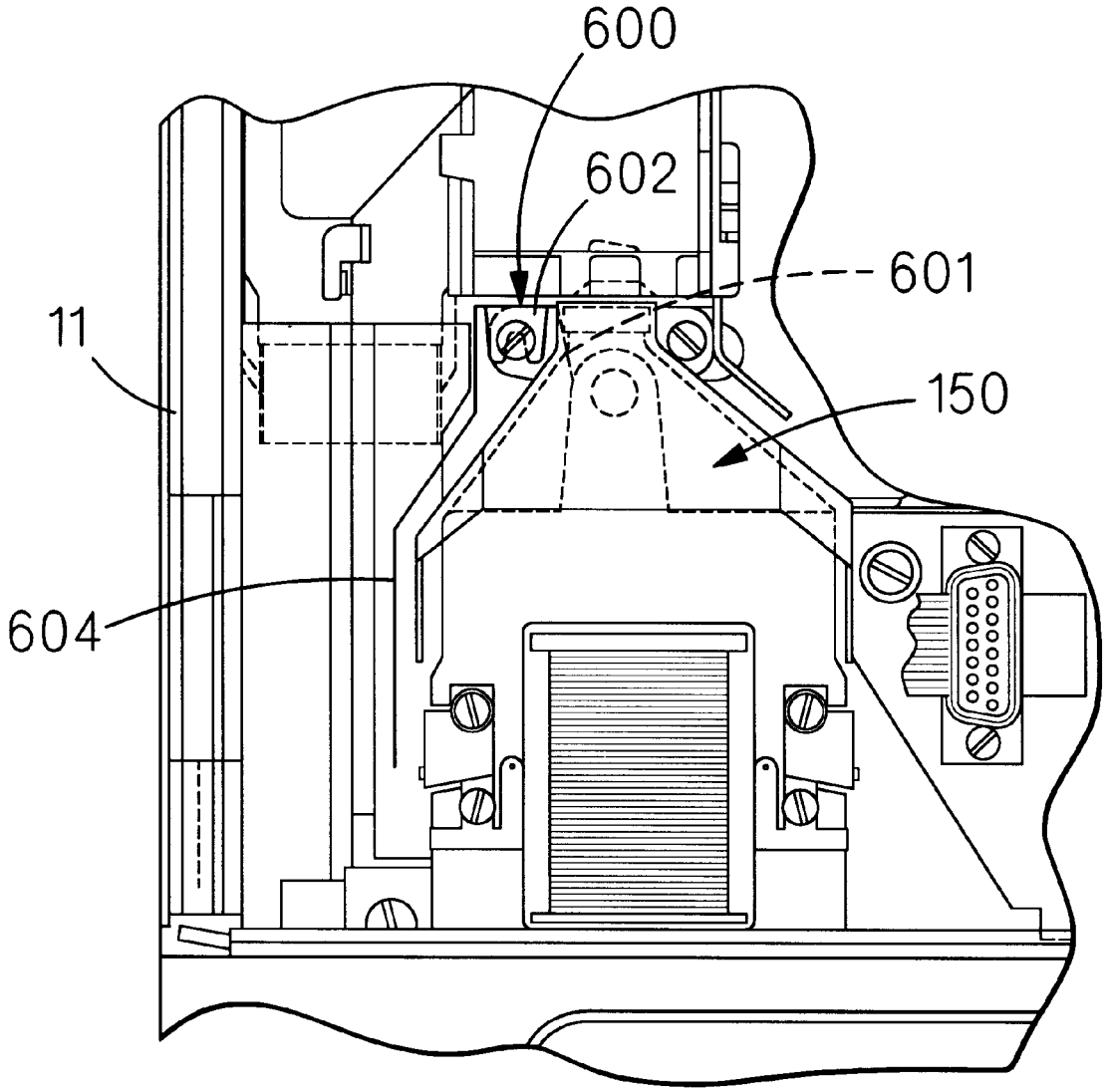
FIG. 8 is a schematic view of a coin hopper having an installed coin diverter.

FIG. 6A, 6B, and 6C illustrate an alternative embodiment of a coin diverter 600. The coin diverter 600 is fashioned with a sloped coin diverter plate 601, a generally U-shaped mounting bracket 602, a top plate 603, and a fraud prevention plate 604. Coin diverter plate 601, mounting bracket 602 and fraud prevention plate 604 are each connected to top plate 603. The fraud prevention plate 604 has a shape enabling it to be positioned between the coin hopper 150 and coin telephone housing box 11 when the coin diverter 600 is mounted to the coin hopper 150. This positioning of fraud prevention plate 604 is illustrated in FIG. 8. Fraud prevention plate 604 is made of metal or other strong, durable material, and may be secured at a single connecting edge to top plate 603. Such a connector allows bending, or "play", of the plate along the connecting edge when a foreign object contacts the plate in an attempt to defraud the payphone, as explained below.

In an exemplary coin diverter 600 designed to retrofit a Western Electric "1A" or "1AAA" coin mechanism, the coin diverter is constructed of stainless steel with a thickness of 0.6 mm. The exemplary coin diverter has a fraud prevention plate 604 with segments 605, 606, and 607 (FIGS. 6A and 6C). Segment 605 has a length measurement "D" of approximately 24.1 mm and a width measurement "G" of approximately 19.0 mm, segment 606 has a length measurement "E" of approximately 17.5 mm and a width measurement "G" of approximately 19.0 mm, and segment 607 has a length measurement "F" of approximately 12.7 mm and a width measurement "J" of approximately 55 mm. Segments 605–607 thus form a fraud prevention plate having a total length measurement of approximately 54.3 mm. Segments 605, 606, and 607 are interconnected at joining angles "H" and "I" that may be, for example, approximately 139 degrees. The dimensions of the diverter plate 601 and mounting bracket 602 may correspond to those of the diverter plate 401 and mounting bracket 402 of a coin diverter 400 (FIGS. 4A–4C) designed to retrofit a Western Electric "1A" or "1AAA" coin mechanism. It should be understood that the fraud prevention plate 604 may be of alternative shapes having, for example, a greater or lesser number of interconnected segments, or may be smoothly curved.

Figure 7A:
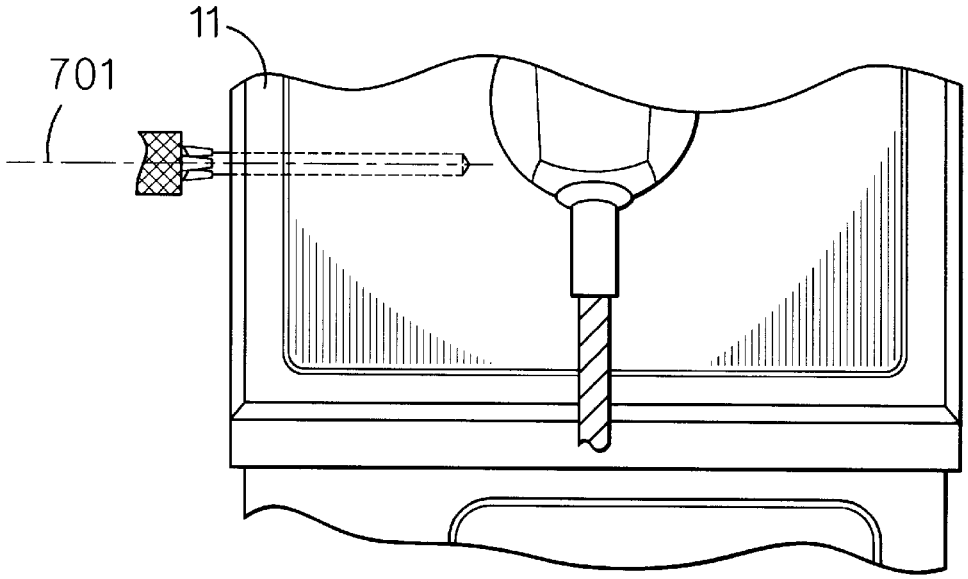
FIGS. 7A and 7B are schematic views of a pay telephone with a mounted coin diverter.
Figure 7B:
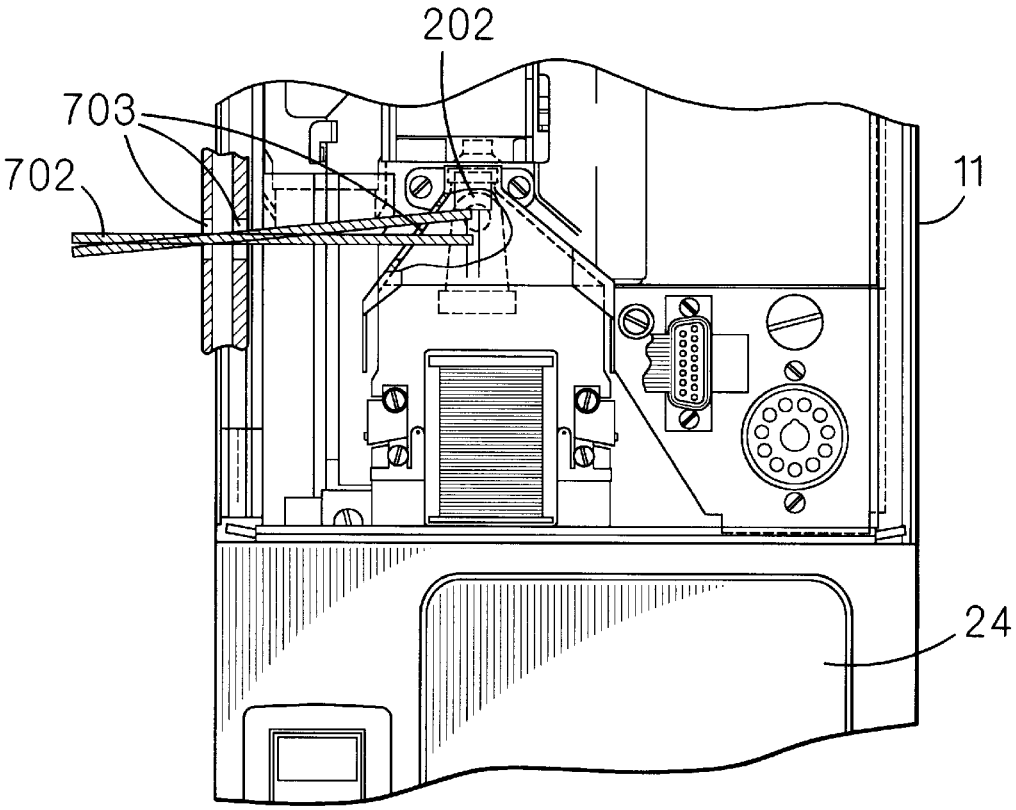

The fraud prevention plate 604 is designed to prevent unlawful tampering with the trip lever 202. Such tampering may be used to cause coin credit registration without a coin being deposited. This type of fraud is referred to as initial rate fraud or local call fraud. Referring to FIGS. 7A and 7B, initial rate fraud may be committed using a high-speed twist drill bit to pierce through the outside wall of the telephone unit housing box 11 along drill axis 701. After removing the drill bit, a thin elongated pin 702 is inserted along the drill axis through the drilled openings 703. The inserted pin is then used to move the trip lever 202 to the triggered position so as to cause fraudulent coin credit registration.

In FIG. 8, a coin diverter 600 with fraud prevention plate 604 is shown mounted on a coin hopper 150. The fraud prevention plate 604 is positioned between the coin hopper 150 and the pay phone housing box 11. When a vandal attempts to drill in the housing box 11 along, for example, axis 701 in FIG. 7A, the drill bit will contact the fraud prevention plate 604 and will displace it from its resting position toward the coin hopper 150. This movement of plate 604 decreases the effective "bite" of the drill bit, thereby increasing the difficulty of gaining access to the coin hopper trip lever. Furthermore, because the plate 604 moves to a displaced position when in contact with the drill, and then returns toward its original position when the drill is removed, the axis of the holes drilled through the phone housing 11 and the coin hopper 150 will be displaced from the hole through the fraud prevention plate 604 when the plate 604 returns toward its normal position. This hole axis misalignment is a further barrier to effective probe pin insertion, thereby making trigger level manipulation more difficult.

It should be understood that the illustrated drilling axis is not be the only applicable fraud drilling axis and that the fraud prevention plate 604 may be used to prevent fraud by a vandal drilling along alternate axes.

The foregoing are illustrative examples of the present invention. Many changes may be made to the disclosed coin diverters including, for example, changes in mounting mechanisms, changes in shape, changes in device proportions, and in the materials used. The scope of this invention should be limited only as set forth in the following claims.

What is claimed is:

1. A coin diverter for minimizing incorrect coin registration in a coin-operated telephone, comprising:

a top plate;

a coin hopper mounting bracket connected to the top plate; and a coin impact plate attached to the top plate, wherein the coin impact plate is positioned in a coin hopper entry path to alter the orientation of a coin entering the hopper.

2. The apparatus of claim 1, wherein the coin diverter is mounted to the coin hopper.

3. The apparatus of claim 1, wherein the diverter plate has a width measurement of approximately 25 mm along a first axis and a length measurement of approximately 9.5 mm along a second axis perpendicular to the first axis.

4. The apparatus of claim 1, further comprising a fraud prevention plate attached to the top plate.

5. The apparatus of claim 4 wherein the fraud prevention plate has a width measurement of approximately 19 mm along a first axis and a length measurement of approximately 54 mm along a second axis perpendicular to the first axis.

6. The apparatus of claim 4 wherein the fraud prevention plate is flexibly attached to the top plate.

7. The apparatus of claim 4 wherein the fraud prevention plate is positioned between the coin hopper and a coin telephone housing box when the coin diverter is mounted.

8. The apparatus of claim 4 wherein the fraud prevention plate comprises interconnected segments.

9. The apparatus of claim 8 wherein the fraud prevention plate comprises three segments.

10. A method for minimizing incorrect coin registration in a coin operated telephone, comprising:

attaching a coin diverter to a coin hopper; and diverting coins entering the coin hopper to prevent impacts on an edge of a trip lever.

11. The method of claim 10, further comprising attaching a fraud prevention plate to the coin diverter to prevent tampering of the trip lever.

* * * * *